US007965957B2

(12) United States Patent
Kubota et al.

(10) Patent No.: US 7,965,957 B2
(45) Date of Patent: Jun. 21, 2011

(54) DEVELOPING DEVICE AND IMAGE FORMING APPARATUS THAT USES THIS DEVELOPING DEVICE

(75) Inventors: Tomohiro Kubota, Osaka (JP); Kenzo Tatsumi, Osaka (JP); Yoshihiro Kawakami, Hyogo (JP); Yoshiyuki Shimizu, Osaka (JP); Hirobumi Ooyoshi, Tokyo (JP); Tomofumi Yoshida, Tokyo (JP); Koji Kato, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 213 days.

(21) Appl. No.: 12/020,915

(22) Filed: Jan. 28, 2008

(65) Prior Publication Data

US 2008/0187358 A1 Aug. 7, 2008

(30) Foreign Application Priority Data

Feb. 2, 2007 (JP) ..... 2007-023975

(51) Int. Cl.
*G03G 15/04* (2006.01)

(52) U.S. Cl. ..... 399/119; 399/120; 399/230; 399/262; 399/263

(58) Field of Classification Search ..... 399/120, 399/230, 262, 263
See application file for complete search history.

(56) References Cited

U.S. PATENT DOCUMENTS

| | | | | |
|---|---|---|---|---|
| 322,279 | A | | 7/1885 | Gerald |
| 378,830 | A | | 2/1888 | Engels et al. |
| 401,618 | A | | 4/1889 | White |
| 5,532,795 | A | | 7/1996 | Tatsumi et al. |
| 5,557,382 | A | | 9/1996 | Tatsumi et al. |
| 5,678,125 | A | | 10/1997 | Kutsuwada et al. |
| 5,734,953 | A | | 3/1998 | Tatsumi |
| 5,765,079 | A | | 6/1998 | Yoshiki et al. |
| 5,815,767 | A | | 9/1998 | Kutsuwada et al. |
| 5,828,935 | A | | 10/1998 | Tatsumi et al. |
| 5,848,342 | A | * | 12/1998 | Tanda ..... 399/358 |
| 5,887,224 | A | | 3/1999 | Mizuishi et al. |
| 5,915,143 | A | | 6/1999 | Watanabe et al. |
| 5,946,531 | A | * | 8/1999 | Miura et al. ..... 399/111 |
| 6,006,050 | A | | 12/1999 | Watanabe et al. |
| 6,055,388 | A | | 4/2000 | Watanabe et al. |

(Continued)

FOREIGN PATENT DOCUMENTS

CN 1441324 A 9/2003

(Continued)

OTHER PUBLICATIONS

U.S. Appl. No. 12/170, filed Jul. 10, 2008, Kubota, et al.

*Primary Examiner* — David P Porta
*Assistant Examiner* — Casey Bryant
(74) *Attorney, Agent, or Firm* — Oblon, Spivak, McClelland, Maier & Neustadt, L.L.P.

(57) ABSTRACT

A developing device configured such that the developing device or the like can be easily inserted and removed without increasing the size of the apparatus, and an image forming apparatus that uses this developing device as well as a process cartridge. The developing device is provided with a first rib formed projecting from a first main wall surface, which is the side surface with the maximum area in the chassis of the developing device, and a second rib formed projecting from a second main wall surface, which is the side surface in opposition to the first main wall surface, the first rib being disposed in a position higher than the second rib in the height direction.

12 Claims, 6 Drawing Sheets

U.S. PATENT DOCUMENTS 6,085,062 A 7/2000 Mizuishi et al.
6,118,959 A 9/2000 Michlin
6,128,449 A 10/2000 Zenba et al.
6,144,811 A 11/2000 Ohori et al.
6,144,822 A 11/2000 Yamaguchi et al.
6,148,161 A 11/2000 Usui et al.
6,160,969 A 12/2000 Ishigaki et al.
D442,214 S 5/2001 Hayashi
D442,624 S 5/2001 Maeshima
6,246,848 B1 6/2001 Morinaga et al.
6,266,501 B1 7/2001 Mizuishi et al.
6,339,689 B1 * 1/2002 Sugiura ..... 399/120
D459,388 S 6/2002 Irie et al.
6,628,903 B1 9/2003 Ohori et al.
6,665,511 B2 12/2003 Takeuchi et al.
D491,979 S 6/2004 Irie et al.
6,771,918 B2 8/2004 Tatsumi
D501,021 S 1/2005 Saiki et al.
6,898,383 B2 5/2005 Ohori et al.
D506,776 S 6/2005 Kobayashi et al.
7,027,761 B2 4/2006 Koetsuka et al.
D524,849 S 7/2006 Komai
D525,289 S 7/2006 Murata
7,110,710 B2 9/2006 Yamashita et al.
7,136,608 B2 11/2006 Miller
7,184,691 B2 2/2007 Kita et al.
7,214,461 B2 5/2007 Yamashita et al.
D559,894 S 1/2008 Sato
7,424,263 B2 * 9/2008 Shimizu et al. ..... 399/358
2003/0219669 A1 11/2003 Yamashita et al.
2006/0024091 A1 * 2/2006 Wegman et al. ..... 399/262
2006/0079358 A1 * 4/2006 Igarashi ..... 474/87
2006/0083545 A1 * 4/2006 Okabe et al. ..... 399/111
2006/0268373 A1 11/2006 Tatsumi et al.
2007/0036581 A1 * 2/2007 Okabe ..... 399/111
2007/0104523 A1 * 5/2007 Yoshida et al. ..... 399/358
2007/0140747 A1 6/2007 Kita et al.
2007/0140763 A1 6/2007 Shimizu et al.
2007/0189812 A1 * 8/2007 Murayama et al. ..... 399/258
2007/0212119 A1 9/2007 Kurenuma et al.
2007/0248390 A1 10/2007 Kubota et al.
2008/0019720 A1 1/2008 Kawakami et al.
2008/0145119 A1 * 6/2008 Tatsumi et al. ..... 399/359
2008/0181692 A1 * 7/2008 Tatsumi et al. ..... 399/358

FOREIGN PATENT DOCUMENTS

EP 1643315 A2 * 4/2006
JP 6-332304 12/1994
JP 2003-66815 3/2003

* cited by examiner

DEVELOPING DEVICE AND IMAGE FORMING APPARATUS THAT USES THIS DEVELOPING DEVICE

BACKGROUND OF THE INVENTION

1. Field of the Invention

The present invention relates to a developing device and an image forming apparatus that uses this developing device and a process cartridge.

2. Description of the Related Art

In recent years, in image forming apparatus such as copiers, printers, facsimile apparatus, and compound machines that combine at least two of these functions, it has been the standard that users change the developing device or process cartridge. Therefore, there is a requirement for a constitution in which the developing device or process cartridge can be easily inserted and removed. As a result providing the developing device or process cartridge with a grip has already been proposed, as disclosed in for example, Japanese Patent Application Laid-open No. H6-332304.

However, color is becoming more widespread in image forming apparatus as described above; in particular the tandem type having a plurality of image carriers is superior for speed, so it is becoming the mainstream. Among this type of apparatus, the type in which four developing devices or process cartridges are disposed in series is known. However, taking into consideration that reduction in machine size is a factor that increases the convenience of the user, normally the developing devices or process cartridges are disposed as close to each other as possible, and the gaps with other units are made narrow.

However, in the case of a unit that integrally includes a developing device which houses toner and a photosensitive member, the size and weight cannot be ignored. Therefore, for size reduction of the apparatus, the developing devices or process cartridges must be disposed as close to each other as possible. As a result if the location in which each unit is inserted is narrow, and if during the operation a unit is mistakenly dropped and impacts another unit, damage can be caused.

Therefore, it is possible to deal with this situation by providing a grip or the like on the units to improve the operability of removing and inserting the units. However, the unit is made larger by the grip, so the size of the body of the image forming apparatus itself that houses the units is made larger. Also, taking the layout of the image forming apparatus into consideration, there is concern that the grip will interfere with the light path of the laser which is located nearby, so there are cases where a grip cannot be simply provided.

In this way, size reduction of the image forming apparatus and operability of inserting and removing the developing device or process cartridge are in an opposing relationship, and it was very difficult to achieve the two at the same time.

SUMMARY OF THE INVENTION

It is an object of the present invention to solve the foregoing problem in the conventional art and to provide a developing device configured such that the developing device or the like can be easily inserted and removed without increasing the size of the apparatus, and an image forming apparatus that uses this developing device as well as a process cartridge.

In an aspect of the present invention, a developing device has a toner housing unit within the chassis thereof and comprises a first rib formed projecting from a first main wall surface, which is the side surface with the maximum area in the chassis; and a second rib formed projecting from a second main wall surface, which is the side surface in opposition to the first main wall surface. The first rib is disposed in a position higher than the second rib in the height direction.

In another aspect of the present invention, an image forming apparatus for forming images using a developing device comprises a top cover whose front side opens and closes about an axis disposed in the far side when viewed from the front surface of a main body of the image forming apparatus, and configured so that the developing device can be inserted and removed from an aperture formed by opening the top cover upwards. The developing device comprises a toner housing unit within the chassis thereof; a first rib formed projecting from a first main wall surface, which is the side surface with the maximum area in the chassis; and a second rib formed projecting from a second main wall surface, which is the side surface in opposition to the first main wall surface, the first rib being disposed in a position higher than the second rib in the height direction, and the first main wall surface of the developing device being disposed to the far side of the image forming apparatus.

In another aspect of the present invention, a process cartridge comprises a developing device integrally formed with at least a photosensitive member. The developing device comprises a toner housing unit within the chassis thereof; a first rib formed projecting from a first main wall surface, which is the side surface with the maximum area in the chassis; and a second rib formed projecting from a second main wall surface, which is the side surface in opposition to the first main wall surface. The first rib is disposed in a position higher than the second rib in the height direction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

The following is a detailed explanation of an embodiment of the present invention with reference to the drawings.

Figure 1:
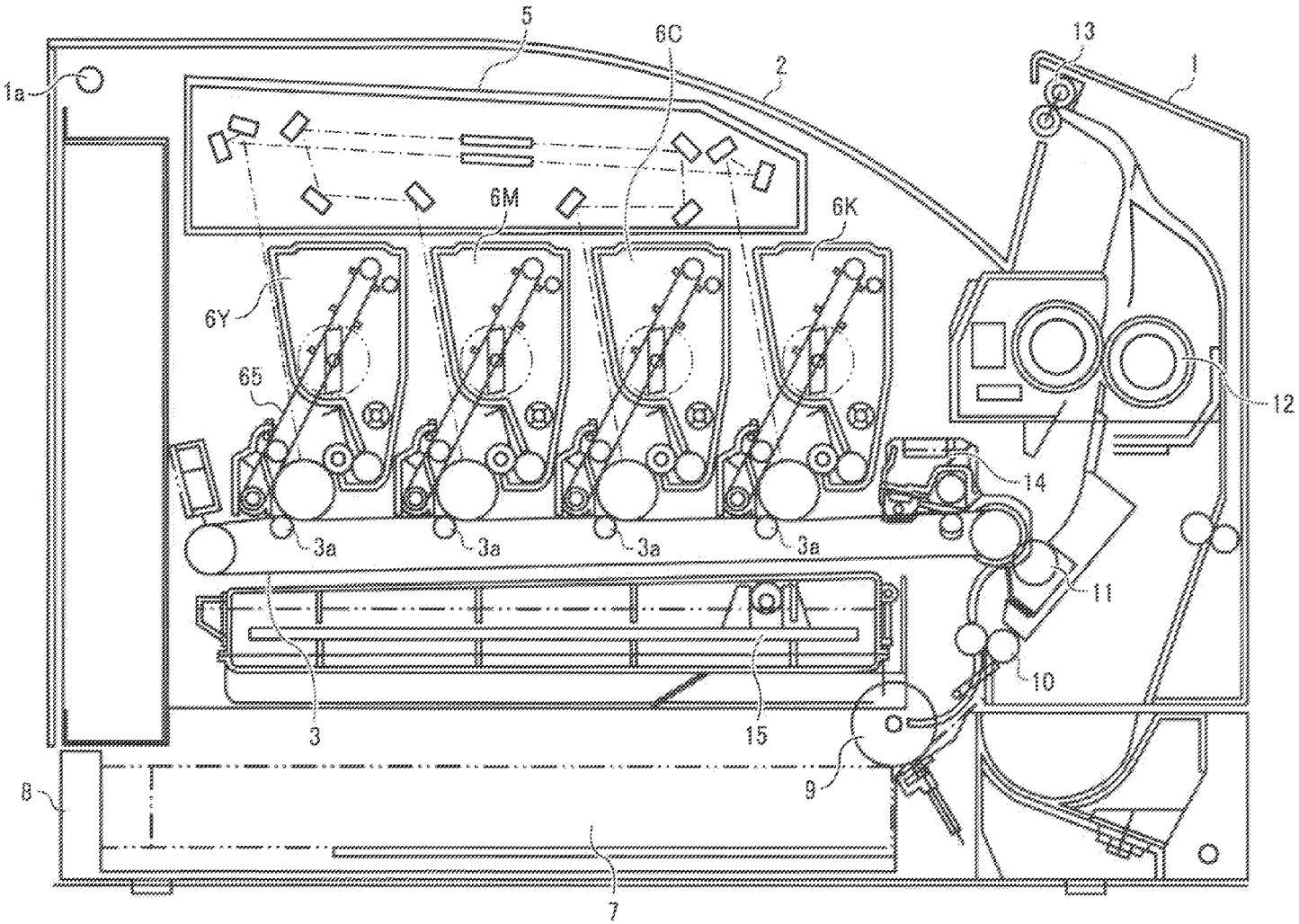
FIG. 1 is a diagram showing the outline constitution of a color printer as an image forming apparatus according to an embodiment of the present invention.

FIG. 1 shows the outline constitution of a color printer as an example of an image forming apparatus according to the present embodiment. The color printer 1 shown here includes four image forming units 6Y, 6M, 6C, 6K disposed in a row in virtually the center of the printer chassis, and a light exposure device 5 for forming latent images on the photosensitive members of the image forming units is disposed above the image forming units 6Y, 6M, 6C, 6K. Below the image forming units 6Y, 6M, 6C, 6K a transfer belt 3 is disposed horizontally and wound around a plurality of support rollers. A second transfer device 11 and an intermediate transfer member cleaning device 14 are disposed to the right side of the transfer belt 3 as seen in FIG. 1. A waste toner recovery container 15 and a sheet supply cassette 8, in which recording media 7 are stacked and housed, are disposed below the transfer belt 3. A recording medium 7 supplied by a sheet supply roller 9 passes between the transfer belt 3 and the second transfer device 11, and is fed to a fixing device 12, where a toner image on the recording medium 7 is thermally fixed.

The colors of the toner images formed by the image forming units 6Y, 6M, 6C, 6K in FIG. 1 are yellow, magenta, cyan, and black respectively, but the constitution and the operation of forming the toner images is exactly the same. Therefore in FIG. 2 one of the image forming units 6 is explained, with the Y, M, C, K removed.

A photosensitive drum 61 is disposed in the bottom of the image forming unit 6 in opposition with the transfer belt 3, and driven to rotate in the clockwise direction 20. In the present embodiment the image carrier is shown as having a drum shape, but a photo sensitive member may also be formed from an endless belt. A cleaning blade 62 as cleaning device for removing residual toner after the primary transfer operation and a charging roller 63 as charging device that contacts the photosensitive drum 61 are provided around the photosensitive drum 61. A toner transport coil 64 that horizontally transports the removed toner is provided near the cleaning blade 62. The toner from the toner transport coil 64 is scooped up by a toner transport belt 65 shown in FIG. 1, and recovered to a waste toner recovery chamber 16*a* in the developing device 16. An unused toner chamber 16*b* is provided in the central part of the developing device 16, partitioned from the waste toner recovery chamber 16*a* by a partitioning member 25 that is made from a flexible material such as film or the like. The unused toner chamber 16*b* is filled with toner of a predetermined color, in the form of minute colored powder. Further, the developing device 16 includes a developing roller 16*c*, an agitator, an agitating roller, a toner replenishment roller 16*g*, and a developing blade 16*h*. The developing roller 16*c* is disposed either with a small gap or in contact with the photosensitive drum 61.

Next, the image forming process in this printer is explained.

Figure 2:
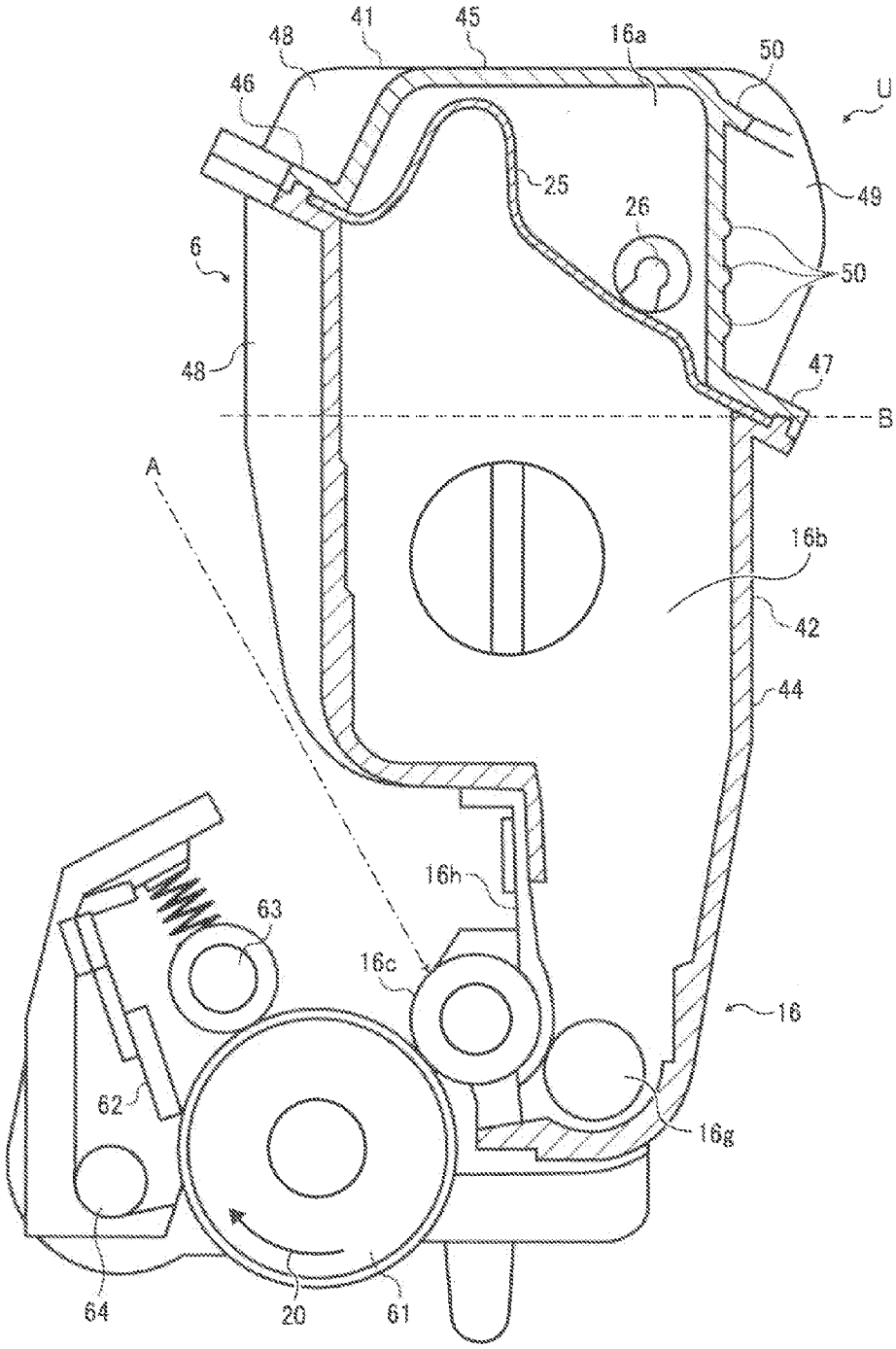
FIG. 2 is a section showing the constitution of the image forming unit of the color printer.

In FIG. 2, the photosensitive drum 61 is rotated in the rotation direction 20 by a drive device (which is not shown in the drawings). A photosensitive layer on the surface of the photosensitive drum 61 is uniformly charged to a high voltage by the charging roller 63. The uniformly charged photosensitive layer is selectively exposed to light by the light exposure device 5 based on image data, to form an electrostatic latent image formed from low voltage parts whose voltage was lowered by the light exposure and high voltage parts from the initialization. Next, when the low voltage parts (or the high voltage parts) of the electrostatic latent image come to the position where the photosensitive drum 61 and the developing roller 16*c* are in opposition, toner is transferred from the developing roller 16*c*, on which a thin layer of toner has been formed, and a toner image is formed (developed). After the first transfer operation, which is described later, toner remaining on the surface of the photosensitive drum 61 is cleaned by the cleaning blade 62 in contact with the photosensitive drum 61. Then residual charge on the drum is removed by a decharging device, which is not shown on the drawings, in preparation for the formation of the next toner image.

Returning to FIG. 1, a first transfer roller 3*a* for the first transfer operation is disposed in a position where each image forming unit 6 is in contact with the transfer belt 3. By applying a high voltage to the first transfer roller 3*a*, a voltage difference is provided between the photosensitive drum 61 and the transfer belt 3, so the toner image formed on the surface of the photosensitive drum 61 is transferred. In each image forming unit 6, the toner image in each color is transferred successively to the transfer belt 3, and a multi-color toner image is formed on the transfer belt 3 by the superposition of the single color toner images. On the other hand, at a certain timing, the recording medium 7 is supplied to the second transfer device 11 from the sheet supply roller 9 and a sheet transport device 10. By applying a high voltage to the second transfer device 11, a voltage difference is formed between the transfer belt 3 and the second transfer device 11, so the toner image (depending on the circumstances, a single color toner image) formed on the surface of the transfer belt 3 is transferred to the recording medium 7.

The recording medium 7 to which the toner image has been transferred is peeled away from the transfer belt 3, the toner image is melted and fixed to the recording medium 7 by the fixing device 12, and the recording medium 7 is discharged to a sheet discharge tray on the top of the printer chassis via a pair of sheet discharge rollers 13. Excess toner remaining on the surface of the transfer belt 3 after the toner image has been transferred to the recording medium 7 is cleaned by the intermediate transfer member cleaning device 14, and recovered in the waste toner recovery container 15. The cleaned transfer belt 3 is ready for the transfer of the next toner image.

The image forming unit 6 according to the present embodiment is constituted by the photosensitive drum 61, the developing device 16, the charging roller 63, and the cleaning blade 62, integrated into a process cartridge. However, the developing device 16 may be constituted as a single, independent unit. Also, when the toner in the unused toner chamber 16*b* of the developing device 16 is used up, the image forming unit 6 or the developing device 16 must be changed for a new unit. The following is an explanation of a changeable process cartridge or developing device 16 using the generic name unit U.

Figure 3:
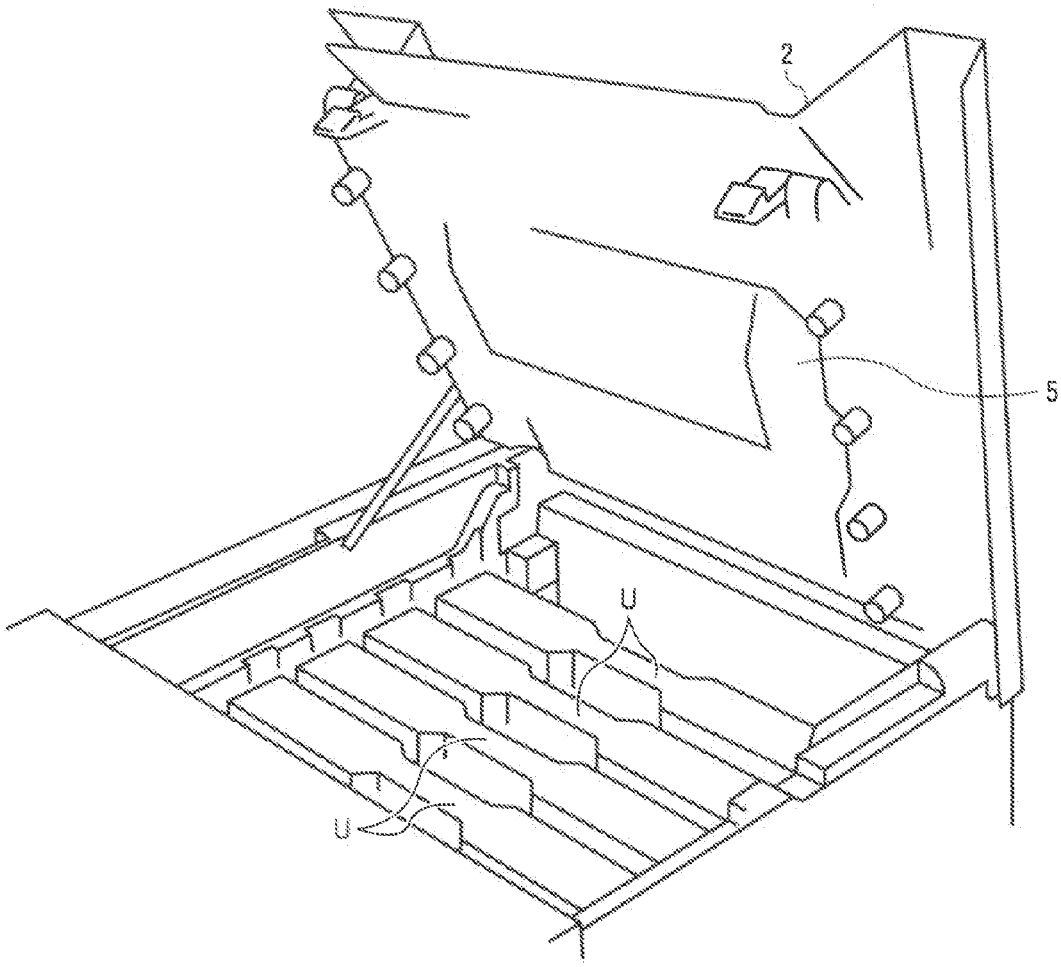
FIG. 3 is an isometric diagram showing the state with the top cover of the color printer opened.
Figure 4:
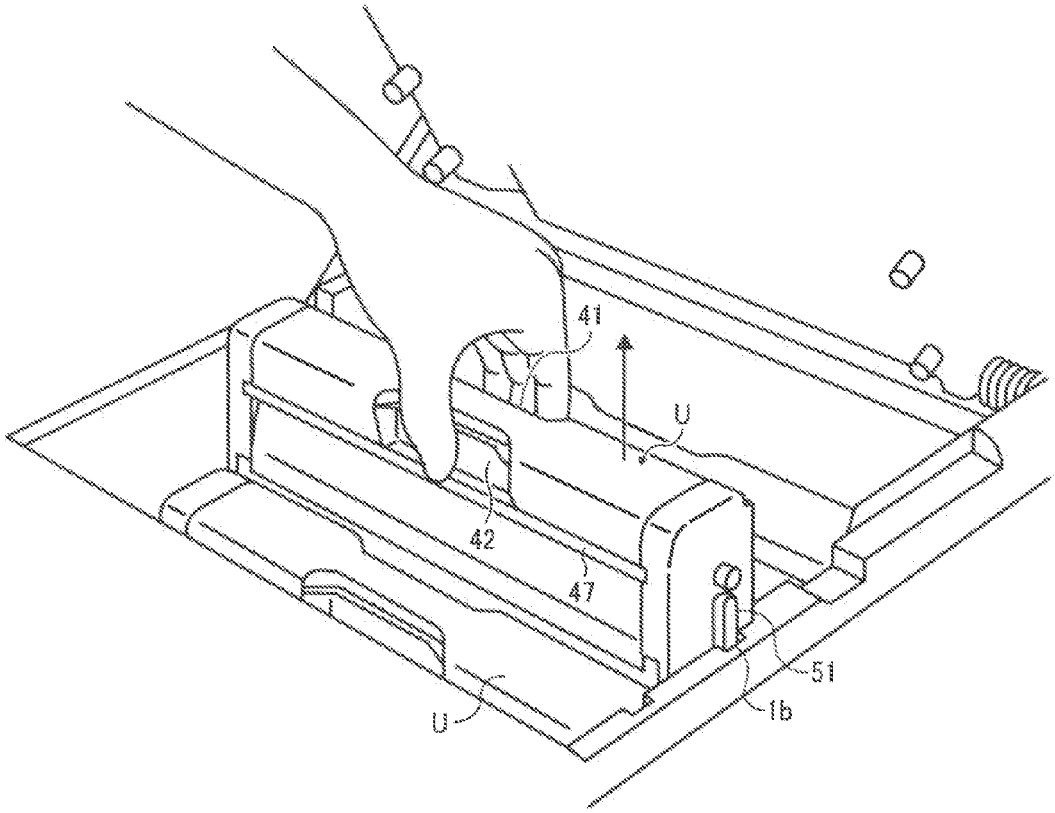
FIG. 4 is an isometric diagram showing an embodiment when a unit is removed from the color printer.

Changing the unit U is carried out as standard by the user. As shown in FIG. 3, in the color printer 1 according to the present embodiment, if a top cover 2 is rotated together with the light exposure device 5 about a rotational support point 1*a* in the far side of the apparatus by raising the near side upward, a row of units U installed within the body of the apparatus can be seen. Then, as shown in FIG. 4, the unit U that is to be changed can be removed by pulling it upwards from the printer 1. Conversely, when inserting the unit U, as shown in FIG. 4, the unit U can be set in the correct position by aligning a guide portion 59 provided on the short side of the unit U with a guide groove 1*b* on the side of the printer and lowering the unit U.

In this way the operation of removing the unit U is very simple. However, the length of the unit U in the long direction is about 30 cm, and the weight is several kilograms, in addition the location that the unit U is to be fitted is narrow. Therefore, during the operation the unit U could be mistakenly dropped, or hit into another unit U, which could cause damage, or similar.

Therefore, in the present embodiment, it is an object to improve the operability of inserting and removing the units U without affecting the compactness of the apparatus, and the following is a detailed explanation of this aspect of the present embodiment.

Figure 5:
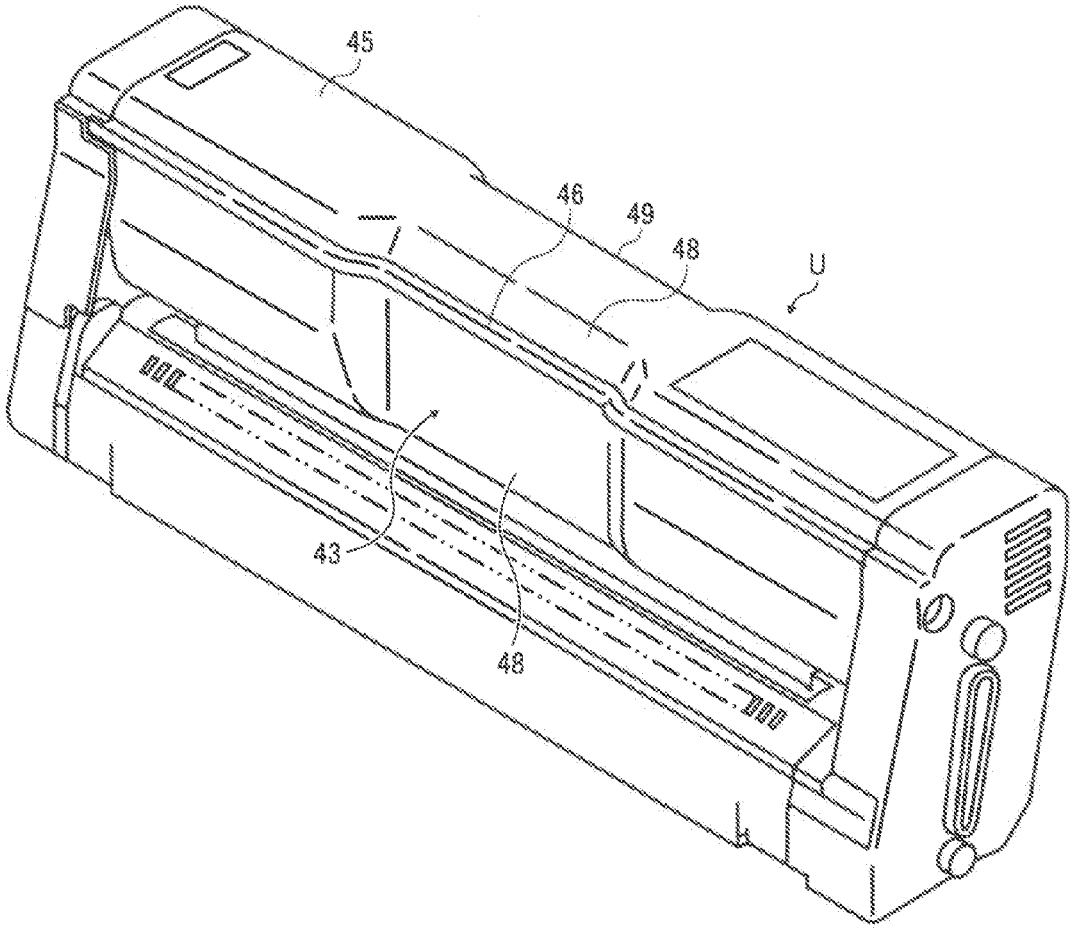
FIG. 5 is an isometric diagram showing an external view of the unit according to the present embodiment seen from one direction.
Figure 6:
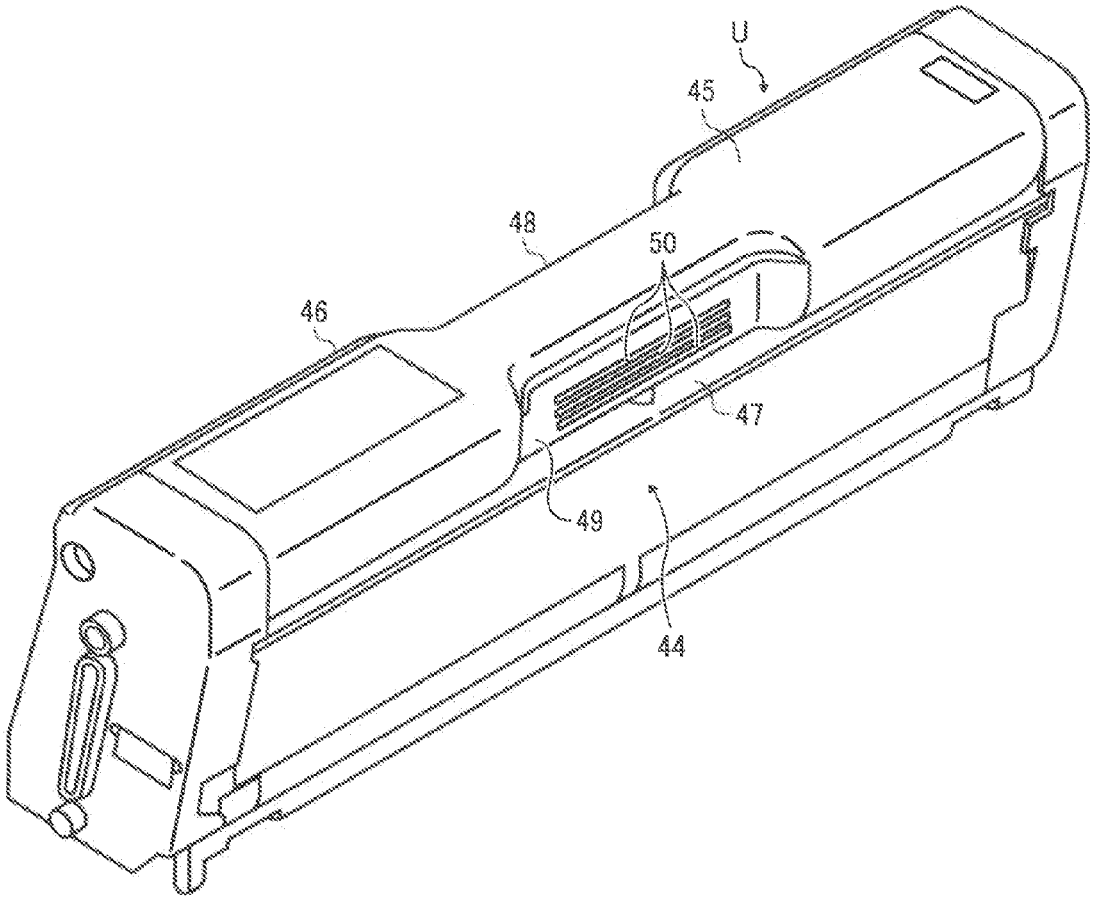
FIG. 6 is an isometric diagram showing an external view of the unit seen from the opposite direction.

In FIGS. 2, 5, and 6, the chassis of the unit U is constituted by a first case 41 located on the top side connected to a second case 42 located on the bottom side. An example of the method of connection is fusion bonding. The unit U has a first main wall surface 43, which is one of the side surfaces of the chassis with the maximum area, a second main wall surface 44 on the opposite side thereof, and a top surface 45.

The fusion bonded portion of the first case 41 and the second case 42 projects to the outside of the wall surface and side surface of the chassis with a rib shape. However, as shown in FIG. 2, the height of a first rib 46 provided in the first main wall surface 43 and the height of a second rib 47 provided in the second main wall surface 44 are different. The first rib 46 is disposed in a position higher than the second rib 47 in the height direction.

As shown in FIG. 4, a user changes the unit U by gripping a manipulation portion in the first main wall surface 43 and a manipulation area in the second main wall surface 44. A part of the first rib 46 is used as the manipulation portion of the first main wall surface 43 on which the fingers of the user are placed on when the user grips the unit. The manipulation area is disposed in a position higher than the second rib 47 in the height direction. At this time, the positional relationship in the height direction of the manipulation portion and the manipulation area is such that the position in the height direction of the first rib 46, which is the manipulation portion, is higher than the broken line B shown in FIG. 2, which is the lower end of the manipulation area. Therefore users can easily apply their fingers when gripping the unit U, so the unit U can be easily gripped.

Further, when inserting and removing the unit U from the printer, the manipulation portion is on the far side relative to the user, and the manipulation area is to the front of the manipulation portion set in a position at the same height or higher, so the unit U is easy to grip, and the operation of inserting and removing is easy.

Configured in this way, when changing the process cartridge that contains the developing device 16, the user can use the first rib 46, which is provided in the topside, as a grip, so the operability is improved when inserting and removing.

In the present embodiment, constituting the chassis of the developing device 16 by fusion bonding the first case 41 and the second case 42 is well known conventionally. When carrying out the fusion bonding of the case, it is necessary to provide a fusion bonding allowance for the part that is melted and bonded, and this fusion bonding allowance is necessarily to the outside of the chassis, so unnecessary space is created for the developing device. However, in chassis of the unit U according to the present embodiment, by making the fusion bonding allowance in the shape of a rib and using it as a grip, there is no need to separately provide a grip, so it is possible to constitute a compact unit U with good operability. It is also possible to form the first rib 46 and the second rib 47 to function only as a grip, unrelated to the fusion bonding allowance.

Depression shapes 48, 49 are provided in the first main wall surface 43 and the second main wall surface 44 respectively of the unit U. When viewed from the top surface 45, the two depression shapes 48, 49 are provided in a position virtually in the center of the unit U in the long direction with a certain width the two depression shapes 48, 49. The depression shape 49 forms the manipulation area referred to above. Also, if the depression shape 49 is provided with one or more projections 50, the projections 50 can function to prevent slippage when the user grips the developing device 16.

The unit U constituted in this way is easy to grip by a user when lifting up by placing the fingers in the depression shapes 48, 49. Also, in the case of the image forming unit 6, part of the photosensitive member 61 or the developing roller 16*c* is exposed, so in order that the user will not touch these parts with their hand, it is possible to make the user intuitively understand that the image forming unit 6 has the depression shapes 48, 49. Preferably two depression shapes 48, 49 are provided in opposition in the unit U, but a depression shape in one of the two locations will also serve the function.

Further, with the constitution as described above, when the user lifts a unit U up in order to change it, it is possible to place the fingers on the projections 50 in the depression shape 49 that is provided on the second rib 47 and the second main wall surface 44, so the unit U is easy to grip. Also, the depression shapes 48, 49 are in locations in opposition on the unit U, so space to place the fingers is provided. At this time, the second rib 47 is set lower than the first rib 46, so even for a user with a small hand, it is possible to use only the first rib 46 on which the fingers can be easily placed as a grip, and not use the second rib 47 as a grip. Also, instead of the second rib 47, the projections 50 may be provided in the depression shape 49 of the second main wall surface 44 as the grip for the case.

Also, by providing the depression shape 48 on the first main wall surface 43, the developing roller 16*c* is visible from the depression shape 48. By providing a constitution in which the surface of the developing roller 16*c* is easily visible from the depression shape 48, the user can determine what color toner is in the developing device 16 when holding the unit U. In other words, the developing roller 16*c* is visible from the direction of the arrow A shown in FIG. 2.

In the case of a full color image forming apparatus, if the position of the developing devices of each color in the image forming apparatus are incorrect, it is not possible to form images in the correct colors. Therefore, it is very important to distinguish the color of the toner in the cartridges. In the present embodiment, it is possible to directly see the developing roller 16*c* that carries the toner, so it is possible to distinguish the color of the toner in the cartridge. Therefore it is possible to reduce incorrect insertion of the units U.

In the unit U, the partitioning member 25 is provided between the first case 41 and the second case 42 to separate the waste toner recovery chamber 16*a* and the unused toner chamber 16*b* in the developing device 16. In other words, the partitioning member 25 is provided between the first case 41 and the second case 42 to completely separate the unused toner chamber 16*b* that houses unused toner prior to developing from the waste toner recovery chamber 16*a* in which transfer residual toner removed from the photosensitive member 61 by the cleaning blade 62 is housed as waste toner. The first rib 46 and the second rib 47 are the portions on which the partitioning member 25 is installed.

By constituting the unit U in this way, the partitioning member 25 is disposed to comply with the first rib 46 and the second rib 47 which are at different heights. Therefore, the partitioning member 25 is inevitably disposed in a sloping manner, so it is possible to effectively utilize the space of the unused toner chamber 16*b* and the waste toner recovery chamber 16*a*, which are within the same volume of the developing case.

The first case 41 includes transport means 26, such as for example a screw, coil, paddle, or the like, for transporting waste toner into the waste toner recovery chamber 16*a* above the partitioning member 25. The transport means 26 is disposed more towards the side of the second main wall surface 44 than towards the first main wall surface 43, and is disposed in a downward location. Also, preferably the partitioning member 25 has an undulating shape to comply with the transport means 26.

By constituting the unit U in this way, the waste toner gathers towards the bottom of the sloping partitioning member 25, and the transport means 26 is located in this part. Therefore, waste toner can be efficiently transported and housed, and the housing area can be made smaller. Also, by providing the partitioning member 25 with an undulating shape, it is possible to reduce the dead space where there is no toner in both the unused toner chamber 16*b* and in the waste toner recovery chamber 16*a*. Therefore it is possible to provide a small developing device.

Also, the partitioning member 25 is for example a sheet in the form of a film made from a material having flexibility, such as sponge, resin, rubber, urethane, or the like. If the partitioning member 25 is a thin sheet material, when the first case 41 and the second case 42 are being fusion bonded, by fusion bonding them with the partitioning member 25 sandwiched between, the partitioning member 25 is fixed, and it is possible to completely separate the unused toner chamber 16*b* from the waste toner recovery chamber 16*a*. In this case, during the initial stage of use of the developing device 16 there is virtually no waste toner, so by bending the partitioning member 25 towards the first case 41 side, it is possible to increase the capacity of the unused toner chamber 16*b*. When the number of sheets printed by the developing device 16 increases, the unused toner decreases and the waste toner increases, so the partitioning member 25 bends towards the second case 42 side, and it is possible to increase the capacity of the waste toner recovery chamber 16*a*.

Next, the color printer 1 using the unit U is explained.

The color printer 1 has the top cover 2 which is opened and closed about the rotational support point 1*a* disposed to the far side as viewed from the front surface. The color printer 1 is constituted so that when a user changes the developing device 16, the developing device 16 is inserted and removed in substantially the vertical direction from an aperture which is formed when the top cover 2 is opened. In addition, the color printer 1 is constituted so that when inserting and removing the developing device 16, the first main wall surface 43 is disposed to the far side of the color printer 1.

By constituting the color printer 1 as described above, when the user opens the top cover 2 and inserts and removes the developing device 16 in substantially the vertical direction, the user's fingers are placed on the first rib 46 on the first main wall surface 41 in the far side as viewed by the user. Therefore, the handlability is good, and the unit U can be reliably inserted and removed without dropping the unit U.

As explained previously, the developing device 16 as a single unit, or the process cartridge being the image forming unit 6 can be applied to the unit U, and in this case, any unit in the form of a cartridge that contains the developing device 16 and has any of the constitutive members such as the photosensitive member 61, the cleaning device 62, and the charging device 63 incorporated therein can be applied as the process cartridge.

The present invention as described above has the following features.

(1) The heights of the ribs located in opposition projecting from the wall surfaces of the developing device are different. By using the upper rib (the first rib) as the manipulation portion, it is not necessary to provide a separate grip, so it is possible to constitute a small developing device with good operability.

(2) The upper rib (the first rib) is used for manipulation, and the height of the manipulation area which is on the opposite side of this rib is higher than the manipulation portion. Therefore it is easy to grip, and it is possible to constitute a small developing device with good operability.

(3) By using the fusion bonding allowance of the first case and the second case as a grip, it is unnecessary to separately provide a grip, so it is possible to constitute a small developing device with good operability.

(4) When the user is raising the unit from above it is possible to grip the depression shapes, so it is possible to provide a developing device with good operability.

(5) Projecting shapes are provided to prevent slipping in the parts where the user grips the developing device, so it is possible to provide a developing device with good operability.

(6) The developing roller is visible from the user, so the color of the developing device is not mistaken.

(7) The respective areas are effectively used, so it is possible to constitute a small developing device.

(8) The waste toner naturally stays near the transport device, so the transport efficiency is increased and the transport area is effectively used, so it is possible to constitute a small developing device.

(9) It is possible to reduce the dead space of both the toner housing unit and the waste toner housing unit, so it is possible to constitute a small developing device.

(10) Both the housing unit and the waste toner recovery unit can be effectively used, so it is possible to constitute a small developing device.

(11) By opening the top cover, which swivels about an axis disposed to the far side when viewed from the front surface, units can be easily inserted and removed in the vertical direction from the aperture.

(12) As a result of the form of the process cartridge, a user can change each device integrally.

Various modifications will become possible for those skilled in the art after receiving the teachings of the present disclosure without departing from the scope thereof.

What is claimed is:

1. A developing device having a toner housing unit within a chassis thereof, comprising:

a first rib formed projecting from a first main wall surface, which is a side surface with the maximum area in the chassis; and a second rib formed projecting from a second main wall surface, the second main wall surface is disposed opposite to the first main wall surface, wherein the first rib is disposed higher than the second rib in a vertical direction, wherein the chassis is formed integrally by joining a first case disposed in a higher position in the vertical direction and a second case disposed in a lower position, and a part of the joint surface forms the first rib and the second rib, wherein the first case has a depression shape formed in at least one of the first main wall surface and the second main wall surface such that a portion of the first case with the depression shape is narrower in a width direction between the first main wall surface and the second main wall surface than a nominal portion of the first case, wherein a developing roller disposed near a bottom of the developing device is directly visible from the depression shape when viewed downward from a top of the developing device, and wherein a partitioning member which partitions the toner housing unit into a first section and second section within the chassis is provided between the first case and the second case, the first section is separate from the second section.

2. The developing device as claimed in claim 1, wherein the chassis comprises a manipulation portion used for a gripping operation and provided in the first main wall surface, and a manipulation area provided in the second main wall surface, a part of the first rib being used as the manipulation portion, and the manipulation portion being disposed in a position higher than the bottom end of the manipulation area in the vertical direction.

3. The developing device as claimed in claim 1, wherein one or more projecting shapes are formed near the second rib in the second main wall surface.

4. The developing device as claimed in claim 1, wherein the first case has transport means for transporting toner into the first section, and the transport means is disposed near the second main wall surface.

5. The developing device as claimed in claim 4, wherein waste toner is stored in the first section and unused toner is stored in the second section.

6. The developing device as claimed in claim 4, wherein the partitioning member has an undulating shape that conforms with the shape of the transport means.

7. The developing device as claimed in claim 1, wherein the partitioning member is made from a material having flexibility.

8. The developing device as claimed in claim 1, further comprising a guide portion disposed on a third wall surface, the third wall surface is perpendicular to the first main wall surface and the second main wall surface.

9. The developing device as claimed in claim 1, wherein a developing blade is disposed between the developing roller and the second case, a first end of the developing blade abuts the second case and a second end of the developing blade abuts the developing roller.

10. An image forming apparatus for forming images using a developing device, comprising:

a top cover whose front side opens and closes about an axis disposed in a far side when viewed from a front surface of a main body of the image forming apparatus, and configured so that the developing device can be inserted and removed from an aperture formed by opening the top cover upwards, wherein the developing device comprises:

a toner housing unit within a chassis thereof;

a first rib formed projecting from a first main wall surface, which is a side surface with the maximum area in the chassis; and a second rib formed projecting from a second main wall surface, which is the side surface in opposition to the first main wall surface, the first rib being disposed higher than the second rib in a vertical direction, and the first main wall surface of the developing device being disposed to the far side of the image forming apparatus, wherein the chassis is formed integrally by joining a first case disposed in a higher position in the vertical direction and a second case disposed in a lower position, and a part of the joint surface forms the first rib and the second rib, wherein the first case has a depression shape formed in at least one of the first main wall surface and the second main wall surface such that a portion of the first case with the depression shape is narrower in a width direction between the first main wall surface and the second main wall surface than a nominal portion of the first case, wherein a developing roller disposed near a bottom of the developing device is directly visible from the depression shape when viewed downward from a top of the developing device, and wherein a partitioning member which partitions the toner housing unit into a first section and second section within the chassis is provided between the first case and the second case, the first section is separate from the second section.

11. A process cartridge, comprising:

a developing device integrally formed with at least a photosensitive member, wherein the developing device comprises:

a toner housing unit within a chassis thereof;

a first rib formed projecting from a first main wall surface, which is a side surface with the maximum area in the chassis; and a second rib formed projecting from a second main wall surface, which is the side surface in opposition to the first main wall surface, the first rib being disposed higher than the second rib in a vertical direction, wherein the chassis is formed integrally by joining a first case disposed in a higher position in the vertical direction and a second case disposed in a lower position, and a part of the joint surface forms the first rib and the second rib, wherein the first case has a depression shape formed in at least one of the first main wall surface and the second main wall surface such that a portion of the first case with the depression shape is narrower in a width direction between the first main wall surface and the second main wall surface than a nominal portion of the first case, wherein a developing roller disposed near a bottom of the developing device is directly visible from the depression shape when viewed downward from a top of the developing device, and wherein a partitioning member which partitions the toner housing unit into a first section and second section within the chassis is provided between the first case and the second case, the first section is separate from the second section.

12. The process cartridge as claimed in claim 11, wherein the process cartridge comprises the developing device which is further integrally formed with at least one of a charging device and a cleaning device.

* * * * *